US006378501B1

(12) United States Patent
Hisato et al.

(10) Patent No.: US 6,378,501 B1
(45) Date of Patent: Apr. 30, 2002

(54) DEVICE FOR CONTROLLING THE FUEL PRESSURE IN A DIRECT CYLINDER FUEL INJECTION ENGINE

(75) Inventors: Hiromichi Hisato; Takeshi Kitao; Takahiko Ono, all of Hyogo; Keiichi Enoki, Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/576,201

(22) Filed: May 23, 2000

(30) Foreign Application Priority Data

Dec. 2, 1999 (JP) ..... 11-343464

(51) Int. Cl.[7] ..... F02M 41/00
(52) U.S. Cl. ..... 123/458
(58) Field of Search ..... 123/458, 457, 123/459, 460, 478, 480, 486; 701/103

(56) References Cited

U.S. PATENT DOCUMENTS 5,771,861 A * 6/1998 Musser et al. ..... 123/357
5,775,304 A * 7/1998 Kono et al. ..... 123/497
5,947,098 A * 9/1999 Hosokawa et al. ..... 123/679

FOREIGN PATENT DOCUMENTS

EP 0892168 A2 * 1/1999
JP 11-37005 2/1999

* cited by examiner

*Primary Examiner*—Willis R. Wolfe
*Assistant Examiner*—Mahmoud Gimie
(74) *Attorney, Agent, or Firm*—Sughrue Mion, PLLC

(57) ABSTRACT

A device for controlling the fuel pressure in a direct cylinder fuel injection engine, which suppresses the over-shooting or under-shooting of fuel pressure under a condition in which the fuel pressure is changing, in order to improve the response and stability. A control means 20A controls the fuel pressure by feedback so that a real fuel pressure PF comes into agreement with a target fuel pressure PFo, and includes a means 204 for operating the fuel pressure correction amount for variably setting a control gain for controlling the fuel pressure by feedback, the means for operating the fuel pressure correction amount so working as to change the control gain when the target fuel pressure has changed by more than a predetermined amount from a first control gain for when the fuel pressure remains steady over to a second control gain for when the fuel pressure changes.

5 Claims, 10 Drawing Sheets

DEVICE FOR CONTROLLING THE FUEL PRESSURE IN A DIRECT CYLINDER FUEL INJECTION ENGINE

BACKGROUND OF THE INVENTION

1. Field of the Invention

The present invention relates to a device for controlling the fuel pressure in a direct cylinder fuel injection engine having a high-pressure pump and a fuel pressure-varying means. More particularly, the invention relates to a device for controlling the fuel pressure in a direct cylinder fuel injection engine featuring improved response and stability in the fuel pressure control when the fuel pressure has shifted from a steady state to a transient state.

2. Prior Art

FIG. 9 is a diagram schematically illustrating the constitution of a general device for controlling the fuel pressure in a direct cylinder fuel injection engine, in which a fuel pressure regulator (fuel pressure-varying means) is controlled by feedback so that the fuel pressure in a high-pressure fuel system acquires a target fuel pressure.

In FIG. 9, a piston 2 is provided in a cylinder of an engine, and a combustion chamber 3 is formed over the piston 2.

An intake pipe 4 and an exhaust pipe 5 are communicated with the combustion chamber 3, and an intake valve 6 and an exhaust valve 7 are provided in the ports among the combustion chamber 3, intake pipe 4 and exhaust pipe 5. An injector 8 and a spark plug 9 are arranged in the combustion chamber 3.

Though not diagramed, here, in the intake pipe 4 are arranged an air filter, an air flow sensor, a throttle valve, a surge tank and an intake manifold from the upstream side in order mentioned. In the exhaust pipe 5 is arranged an air-fuel ratio sensor for detecting the oxygen concentration.

The air taken in by the engine 1 is distributed into the intake pipe 4 connected to the cylinders through the air filter, air flow sensor, throttle valve and intake manifold.

Fuel such as gasoline is pressurized by a low-pressure pump 11 and is fed from a fuel tank 10 to a low-pressure conduit 12, and is further pressurized by a high-pressure pump 13 and is fed to an injector 8 through a high-pressure conduit 14.

The high-pressure conduit 14 is communicated with a high-pressure return conduit 14A through the injector 8, and the output end of the high-pressure return conduit 14A is connected to a low-pressure return conduit 16 through a fuel pressure regulator 15.

The fuel pressure regulator 15 increases or decreases the opening degree at the output end of the high-pressure return conduit 14A to adjust the amount of fuel returned to the low-pressure return conduit 16 in order to adjust the real fuel pressure PF (hereinafter also simply referred to as "fuel pressure") of the injector 8 to a target fuel pressure PFo.

The fuel pressure regulator returns part of fuel in the high-pressure conduit 14 back to the fuel tank 10 through the low-pressure return conduit 16 to lower the fuel pressure PF, and further closes the output end of the high-pressure return conduit 14A to raise the fuel pressure PF.

When no exciting current Ri is supplied to the fuel pressure regulator 15, the fuel pressure PF in the high-pressure conduit 14 is adjusted by the urging force of a spring (described later) in the fuel pressure regulator 15.

The fuel of a target fuel pressure PFo supplied to the high-pressure conduit 14 is injected into the combustion chamber 3 through the injector 8 provided for each of the cylinders.

The fuel pressure sensor 17 detects the fuel pressure PF in the high-pressure conduit 14.

The air flow sensor and the throttle sensor in the intake pipe 4 detect the flow rate of the air taken in and the throttle opening degree, and a water temperature sensor 18 detects the cooling water temperature WT of the engine 1.

The crank angle sensor 19 forms a crank angle signal CA that represents the rotational position of the engine 1. The air-fuel ratio sensor (not shown) in the exhaust pipe 5 forms an air-fuel ratio signal that represents the oxygen concentration in the exhaust gas.

The above-mentioned sensors send signals representing the operating conditions of the engine 1 as operating condition data to an electronic control unit (ECU) 20.

The ECU 20 reads operating condition data from the sensors, executes a predetermined arithmetic operation, and sends control signals operated as a result of operation to the actuators.

For instance, the ECU 20 supplies an exciting current Ri to the fuel pressure regulator 15 based on the fuel pressure PF detected by the fuel pressure sensor 17 (and data of various sensors), in order to control the fuel pressure PF.

Though not diagramed here, the fuel pressure regulator 15 is provided with a low-pressure regulator in series to suppress the pulsation of fuel pressure in the high-pressure conduit 14.

As means for varying fuel pressure in the high-pressure conduit 14, there can be used those of various constitutions that have been known without being limited to the high-pressure pump 13 and the fuel pressure regulator 15 shown in FIG. 9.

FIG. 10 is a vertical sectional view illustrating, in detail, the structure of the fuel pressure regulator 15, and in which portions same as those described above (see FIG. 9) are denoted by the same reference numerals but are not described in detail again.

In FIG. 10, the fuel pressure regulator 15 includes an electromagnetic coil 151, a magnetic circuit 152, a plunger 153, a valve 154, a valve seat 155, a through hole 156, a communication hole 157 and a spring 158.

Being excited by a duty control with an exciting current Ri, the electromagnetic coil 151 closes the high-pressure return conduit 14A. The magnetic circuit 152 forms a passage of a magnetic flux generated by the excitation of the electromagnetic coil 151.

The plunger 153 is driven in a direction in which it protrudes when the electromagnetic coil 151 is excited. The valve 154 is integrally formed at an end of the plunger 153. The valve seat 155 is arranged being opposed to the valve 154.

The through hole 156 is formed in the center of the valve seat 155, and an output end of the high-pressure return conduit 14A is connected to the through hole 156.

The communication hole 157 penetrates through the side surface neighboring the through hole 156. The low-pressure return conduit 16 is connected to the communication hole 157.

The spring 158 urges the plunger 153 in a direction in which it protrudes.

Next, concrete steps of adjusting the fuel pressure PF by the fuel pressure regulator 15 shown in FIG. 10 will be described with reference to FIGS. 11 and 12.

FIG. 11 shows basic characteristics of the fuel pressure regulator 15, and FIG. 12 shows basic characteristics of the blow-out amount of the high-pressure pump 13.

In FIG. 11, the abscissa represents the duty value (current value) of the exciting current Ri, the ordinate represents the fuel pressure PF, and the fuel pressure PF increases with an increase in the exciting current Ri (current value) starting from the adjusted pressure RS due to the urging force of the spring 158.

In FIG. 12, the abscissa represents the rotational speed of the high-pressure pump 13 corresponding to the engine rotational speed Ne, the ordinate represents the amount of fuel QF blown out from the high-pressure pump 13, and the blow-out amount of fuel QF increases with an increase in the engine rotational speed Ne (pump rotational speed).

In FIG. 10, when the exciting current Ri is supplied from the ECU 20, the electromagnetic coil 151 in the fuel pressure regulator 15 controls the sucking force of the plunger 153 through the magnetic circuit 152 using the magnetic flux generated by the exciting current Ri.

In this case, the valve 154 is pushed onto the valve seat 155 with a maximum force when the exciting current Ri is maximum (when the duty is maximum).

The fuel pressure PF in the high-pressure return conduit 14A (high-pressure conduit 14) is controlled by the amount of fuel that flows from the output end of the high-pressure return conduit 14A into the communication hole 157 through the hole 156.

Therefore, the amount of fuel flowing through decreases with an increase in the exciting current Ri, and the fuel pressure PF increases. When the current is 0 [A], i.e., when the duty of the exciting current Ri is a minimum (=0%), the opening area between the valve 154 and the valve seat 155 becomes a maximum, and the fuel pressure PF is adjusted to a predetermined value due to the urging force of the spring 158.

As described above, the conventional device for controlling the fuel pressure in a direct cylinder fuel injection engine is equipped with the high-pressure pump 13 driven by the engine, and the fuel of a high pressure is directly injected into the combustion chamber 3 through the injector 8 provided in each combustion chamber 3.

The fuel pressure PF in the high-pressure conduit 14 communicated with the injector 8 is adjusted to an optimum target fuel pressure PFo that is operated by taking the operating conditions such as engine speed and engine load into consideration. That is, the fuel pressure PF detected by the fuel pressure sensor 17 is controlled by the exciting current Ri from the ECU 20 to be in agreement with the target fuel pressure PFo.

When the target fuel pressure PFo sharply changes, for example, when the target fuel pressure PFo instantaneously increases and, then, decreases, however, the fuel pressure feedback operation amount is not properly given, and there may occur over-shooting or under-shooting of the fuel pressure PF.

In order to suppress the over-shooting or the under-shooting, there has been proposed a device for controlling the fuel pressure as disclosed in, for example, Japanese Unexamined Patent Publication (Kokai) No. 11-37005.

When the fuel pressure remains steady during the normal operation, in this case, the output duty of the exciting current Ri is controlled to remain constant, and the fuel pressure PF is so controlled by feedback as to come into agreement with the target fuel pressure PFo.

When the target fuel pressure PFo determined by the operating conditions has changed by more than a predetermined amount, on the other hand, the fuel pressure feedback control is discontinued, and the fuel pressure is controlled based on the fuel pressure feedback amount of when the fuel pressure feedback control is discontinued and on a reference control amount (duty value) determined by the operating conditions at that moment.

Then, the fuel pressure feedback control is resumed when a difference between the target fuel pressure PFo and the real fuel pressure PF converges within a predetermined range (determined depending on the temperature of the fuel pressure regulator 15, applied voltage of when the exciting current Ri is supplied, aging, etc.) and when this state has continued for more than a predetermined period of time.

That is, the fuel pressure feedback control is resumed under the conditions in which the difference between the target fuel pressure PFo and the real fuel pressure PF lies within a predetermined range and continues for a predetermined period of time.

When the difference between the target fuel pressure PFo and the fuel pressure PF does not converge within the predetermined range due to some unexpected cause while the fuel pressure is changing accompanying a change in the target fuel pressure PFo, however, the difference in the fuel pressure does not converge no matter how long period of time elapses since the fuel pressure feedback control remains halted, and the fuel pressure feedback control is not resumed.

According to the conventional device for controlling the fuel pressure in a direct cylinder fuel injection engine as described above, when the target fuel pressure PFo has sharply changed, the fuel feedback control is discontinued until the difference in the fuel pressure from the fuel pressure PF converges within a predetermined range in order to suppress the over-shooting or under-shooting of the fuel pressure PF when the fuel pressure is changing. When the difference in the fuel pressure does not converge within the predetermined range, therefore, the fuel pressure feedback control is not resumed.

SUMMARY OF THE INVENTION

The present invention was accomplished in order to solve the above-mentioned problem, and its object is to provide a device for controlling the fuel pressure in a direct cylinder fuel injection engine, which suppresses the over-shooting or under-shooting of fuel pressure under a transient fuel pressure condition in which the target fuel pressure changes by more than a predetermined amount, and reliably converges the difference in the fuel pressure in order to improve the fuel pressure transience control performance.

A device for controlling the fuel pressure in a direct cylinder fuel injection engine of the present invention comprises:

- various sensors for detecting the operating conditions of an engine;
- an injector for directly injecting fuel into a cylinder of said engine;
- a pump for feeding fuel to said injector;
- a conduit system for connecting said pump to said injector;
- a fuel pressure detecting means for detecting the real fuel pressure acting on said injector;
- a fuel pressure varying means for adjusting said real fuel pressure; and
- a control means for so controlling the fuel pressure by feedback that said real fuel pressure is brought into agreement with a target fuel pressure; wherein said control means includes a means for operating the fuel pressure correction amount for variably setting a control gain for controlling the fuel pressure by feedback; and said means for operating the fuel pressure correction amount changes the control gain when said target fuel pressure has changed by more than a predetermined amount from a first control gain of when the fuel pressure remains steady over to a second control gain for when the fuel pressure changes.

The invention is further concerned with a device for controlling the fuel pressure in a direct cylinder fuel injection engine, wherein the means for operating the fuel pressure correction amount returns the control gain back to said first control gain at a moment when a predetermined period of time has passed from when the control gain is changed from said first control gain over to said second control gain.

The invention is further concerned with a device for controlling the fuel pressure in a direct cylinder fuel injection engine, wherein the means for operating the fuel pressure correction amount returns the control gain back to said first control gain after a state in which a difference between a target fuel pressure and a real fuel pressure lies within a predetermined range has continued for a predetermined period of time.

The invention is further concerned with a device for controlling the fuel pressure in a direct cylinder fuel injection engine, wherein the means for operating the fuel pressure correction amount variably sets said second control gain depending upon the operating conditions.

The invention is further concerned with a device for controlling the fuel pressure in a direct cylinder fuel injection engine, wherein the means for operating the fuel pressure correction amount variably sets said second control gain depending upon a difference between said target fuel pressure and said real fuel pressure.

DESCRIPTION OF THE PREFERRED EMBODIMENTS

EMBODIMENT 1

An embodiment 1 of the present invention will now be described with reference to the drawings.

Figure 1:
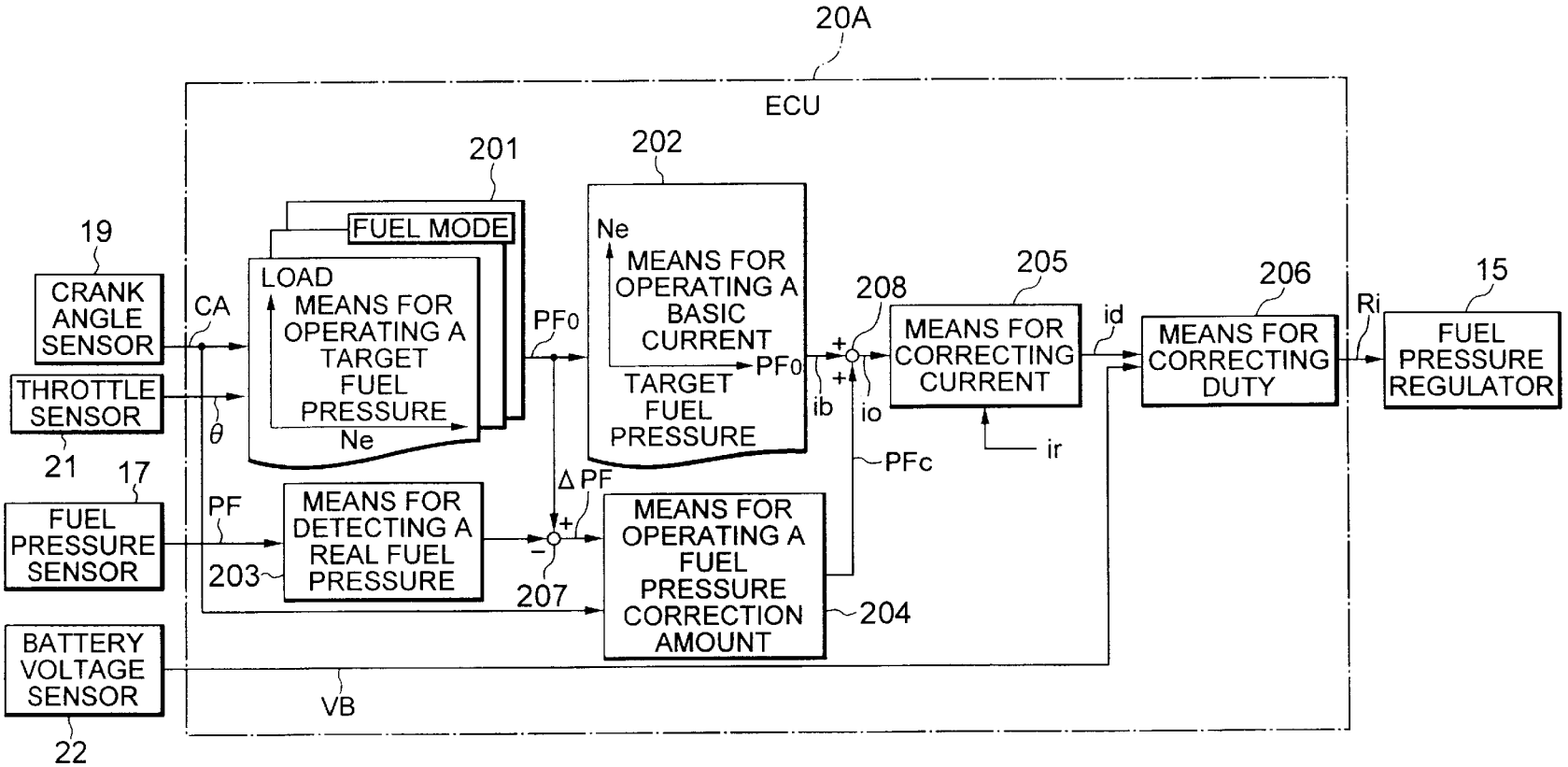
FIG. 1 is a block diagram schematically illustrating the constitution of an embodiment 1 of the present invention.
Figure 9:
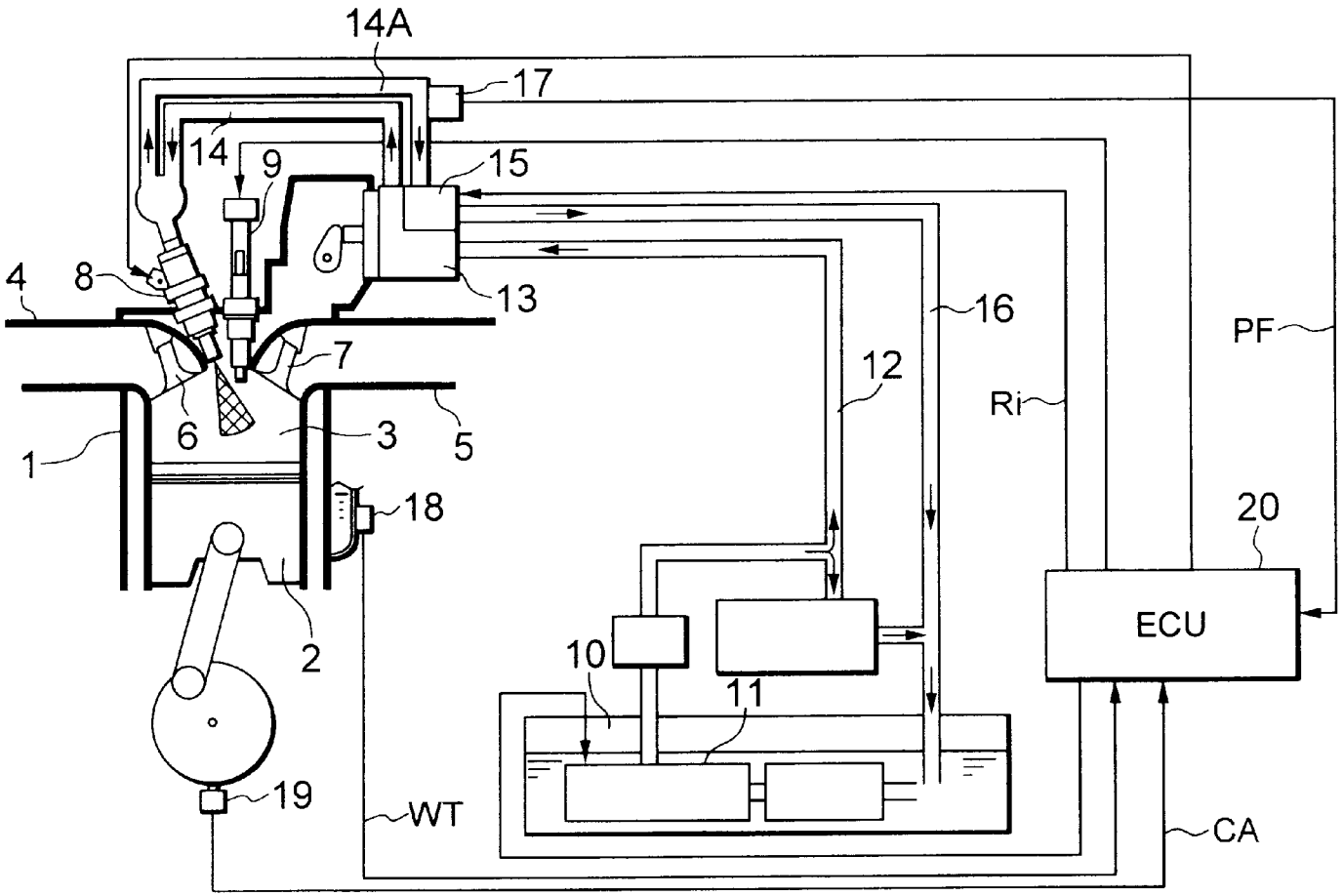
FIG. 9 is a diagram schematically illustrating the constitution of a conventional device for controlling the fuel pressure in a direct cylinder fuel injection engine.
Figure 10:
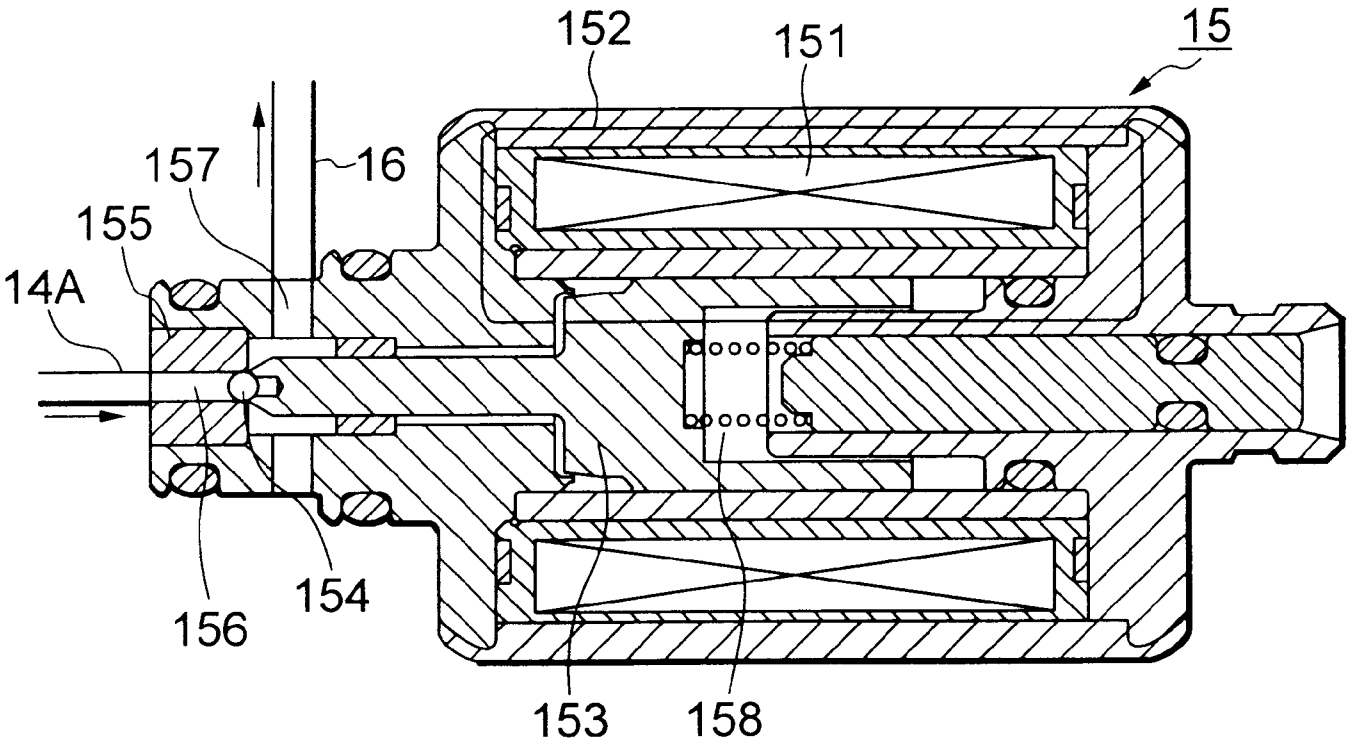
FIG. 10 is a vertical sectional view illustrating the structure of a fuel pressure regulator of FIG. 9.
Figure 11:
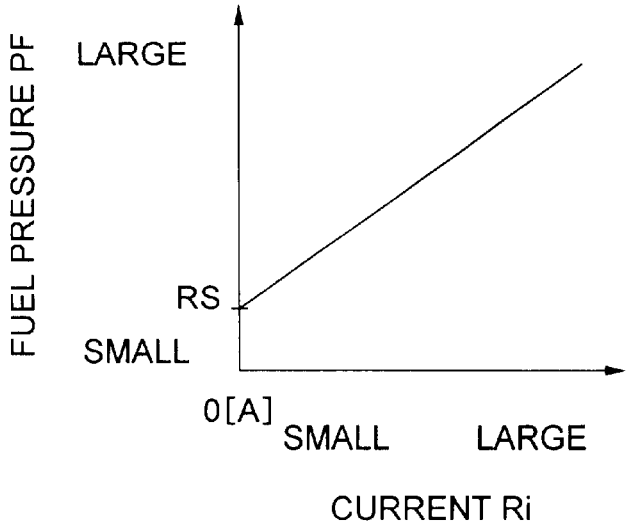
FIG. 11 is a diagram illustrating the basic characteristics of the fuel pressure regulator of FIG. 9.
Figure 12:
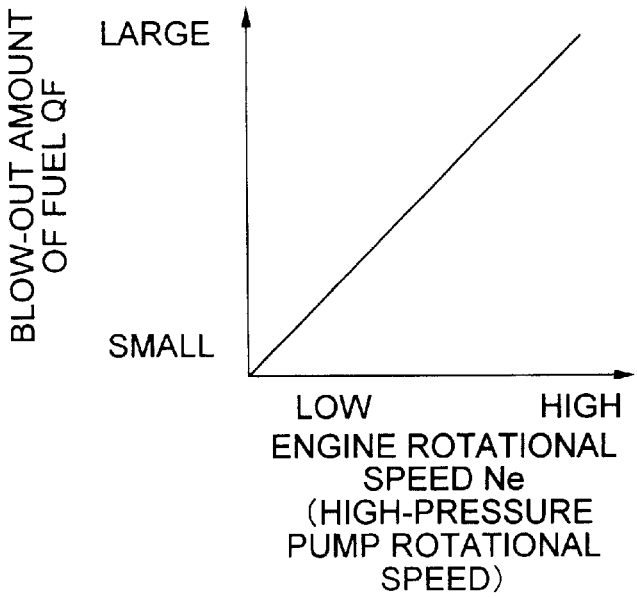
FIG. 12 is a diagram illustrating the basic characteristics of a high-pressure pump of FIG. 9.

FIG. 1 is a block diagram schematically illustrating the constitution of the embodiment 1 of the present invention. The constitution that is not diagramed is as shown in FIGS. 9 and 10. In FIG. 1, further, the portions same as those described above (see FIG. 9) are denoted by the same reference numerals but are not described here again in detail.

Figure 2:
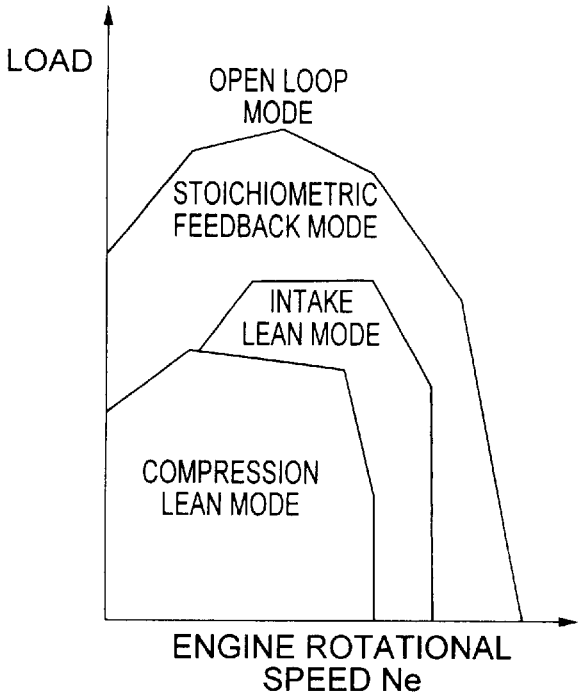
FIG. 2 is a diagram illustrating the combustion modes in the operating conditions, wherein the axes represent the engine rotational speed and the engine load used by a means for operating the target fuel pressure of FIG. 1.

FIG. 2 is a diagram illustrating the combustion modes that are set based upon the operating conditions (engine rotational speed Ne, engine load).

In FIG. 2, the combustion mode is successively changed from the compression lean mode over to intake lean mode, stoichiometric feedback mode and to open loop mode depending upon an increase in the engine rotational speed Ne and in the load.

In the compression lean mode, the fuel is injected in the compression stroke to execute a very lean stratified combustion.

In the intake lean mode, the fuel is injected in the intake stroke to execute the combustion in a state of lean fuel (air-fuel ratio which is more on the lean side than the stoichiometric air-fuel ratio) though this is not as lean as in the compression lean mode.

In the stoichiometric feedback mode, further, the combustion is executed at the stoichiometric air-fuel ratio based on an oxygen concentration signal from the air-fuel ratio sensor.

In the open loop mode, further, the feedback is not executed, and the combustion is executed in a state where the fuel is excessively rich.

Figure 3:
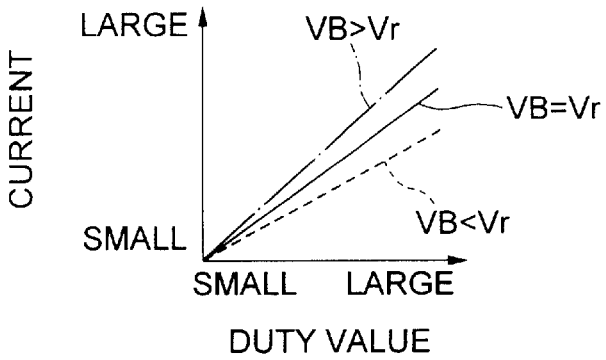
FIG. 3 is a diagram illustrating the duty-current-voltage characteristics of a fuel pressure regulator of FIG. 1.

FIG. 3 is a diagram illustrating a relationship between the duty value of the exciting current Ri and the current value.

In FIG. 3, the characteristics of the current value to the duty value differ as represented by a solid line, a broken line and a dot-dash chain line depending upon the magnitude of the battery voltage VB with respect to a reference voltage Vr.

In FIG. 1, a throttle sensor 21 and a battery voltage sensor 22 are connected to the ECU 20 in addition to the fuel pressure sensor 17 and crank angle sensor 19.

The throttle sensor 21 detects the throttle opening degree θ, and the battery voltage sensor 22 detects the battery voltage VB.

The ECU 20A includes a means 201 for operating a target fuel pressure, means 202 for operating a basic current, means 203 for detecting a real fuel pressure, means 204 for operating the fuel pressure correction amount, means 205 for correcting current, means 206 for correcting output duty, a subtractor 207 and an adder 208.

The means 201 for operating the target fuel pressure determines a target fuel pressure PFo corresponding to the operating conditions based on the engine rotational speed Ne obtained from a crank angle signal CA, the engine load obtained from a throttle opening degree θ and a four-dimensional map corresponding to the combustion modes (see FIG. 2).

The means 202 for operating the basic current determines a basic target current value ib in the target fuel pressure PFo from the three-dimensional map corresponding to the target fuel pressure PFo and the engine rotational speed Ne.

The means 203 for detecting the real fuel pressure converts the fuel pressure PF (detection signal) from the fuel pressure sensor 17 into a signal to detect it as a real fuel pressure.

The subtractor 207 operates a difference ΔPF in the fuel pressure between the real fuel pressure PF and the target fuel pressure PFo.

The means 204 for operating the fuel pressure correction amount operates the fuel pressure correction amount (current value) PFc by PI control in order to feed back the fuel pressure based on the difference ΔPF in the fuel pressure, and changes over the fuel pressure feedback control gain (described later) depending upon the steady fuel pressure and the transient fuel pressure.

That is, when the target fuel pressure PFo has changed by more than a predetermined amount, the means 204 for operating the fuel pressure correction amount changes the control gain over to a second control gain for when the fuel pressure changes, which is smaller than a first control gain of when the fuel pressure remains steady.

Further, the means 204 for operating the fuel pressure correction amount has a function for returning the control gain back to the first control gain after the passage of a redetermined period of time from when the control gain was changed from the first control gain over to the second control gain (after the passage of a predetermined period of time from when the fuel pressure has started changing).

The means 204 for operating the fuel pressure correction amount further has a function for returning the control gain back to the first control gain when a state in which a difference between the target fuel pressure and the real fuel pressure lies within a predetermined range has continued for a predetermined period of time.

Further, the means 204 for operating the fuel pressure correction amount has a function for variably setting the second control gain depending on the operating conditions and for variably setting the second control gain depending on a difference between the target fuel pressure and the real fuel pressure.

The adder 208 adds up the basic current value ib and the fuel pressure correction amount PFc together to operate a target current value io.

The means 205 for correcting the current changes the current value (duty value) id from a difference Δi between the target current value io and the real current value ir, and executes the current feedback control so that the target current value io comes into agreement with the real current value ir.

The current value id operated by the means 205 for correcting the current is defined by-the characteristics at the reference voltage Vr, and is obtained by correcting a duty value at a real battery voltage VB into a value corresponding to the reference voltage.

The means 206 for correcting duty corrects characteristics based on the battery voltage VB with respect to the current value id operated by the means 205 for the correcting current (see FIG. 3), and operates a duty value of exciting current Ri finally output from the ECU 20A to the fuel pressure regulator 15.

Figure 4:
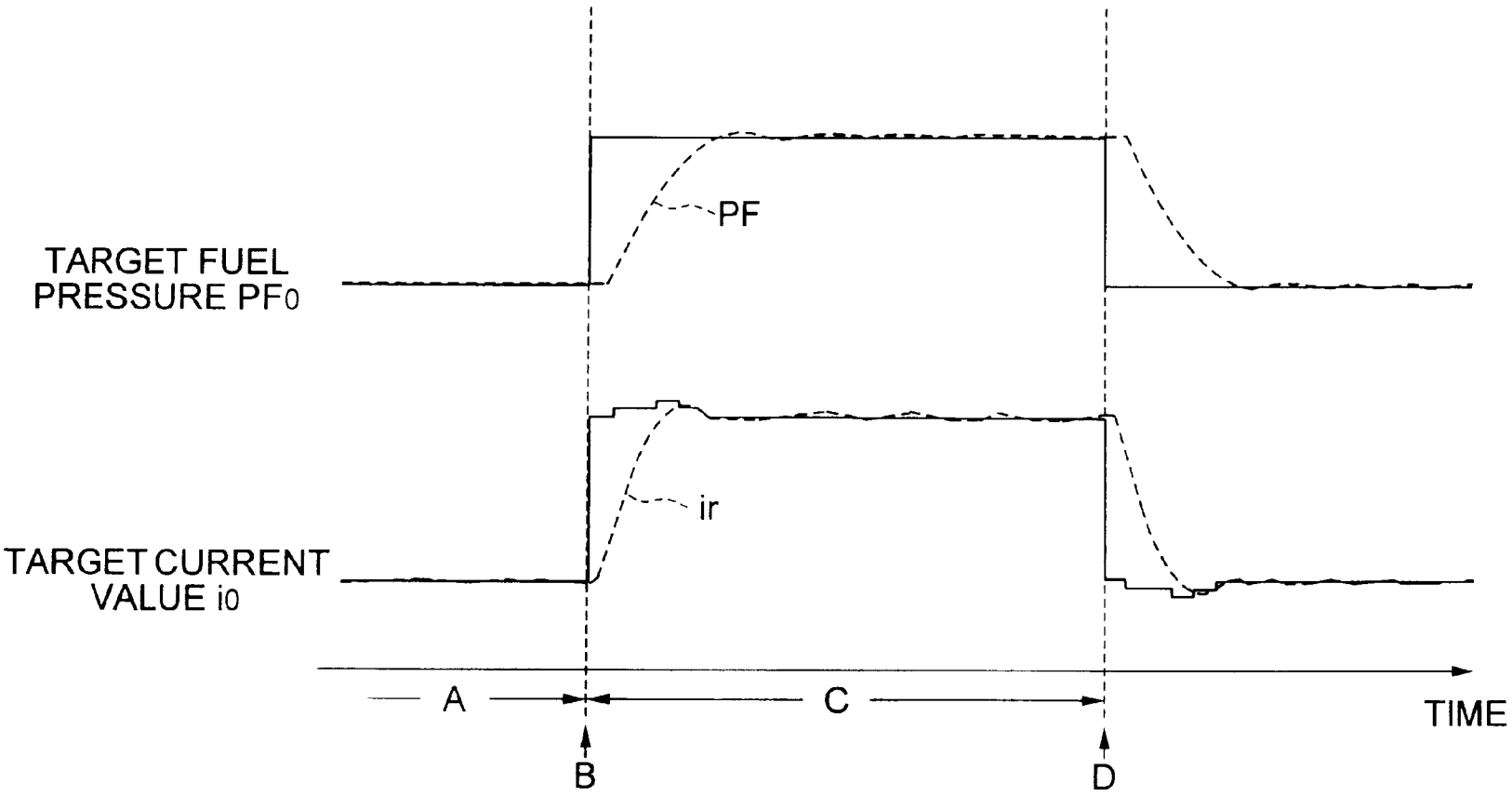
FIG. 4 is a timing chart illustrating the operation according to the embodiment 1 of the present invention.

FIG. 4 is a timing chart illustrating a change in the target current value io of when the target fuel pressure PFo is changed over, wherein broken lines corresponding to the solid lines represent a real fuel pressure PF and a real current value ir.

In FIG. 4, the region A represents a state where the vehicle is steadily traveling at a given fuel pressure, the time B represents a timing at which the target fuel pressure PFo sharply increases due to a change in the operating conditions, the region C represents a state where the vehicle is steadily traveling at an increased fuel pressure, and the time D represents a timing at which the target fuel pressure PFo sharply decreases.

Figure 5:
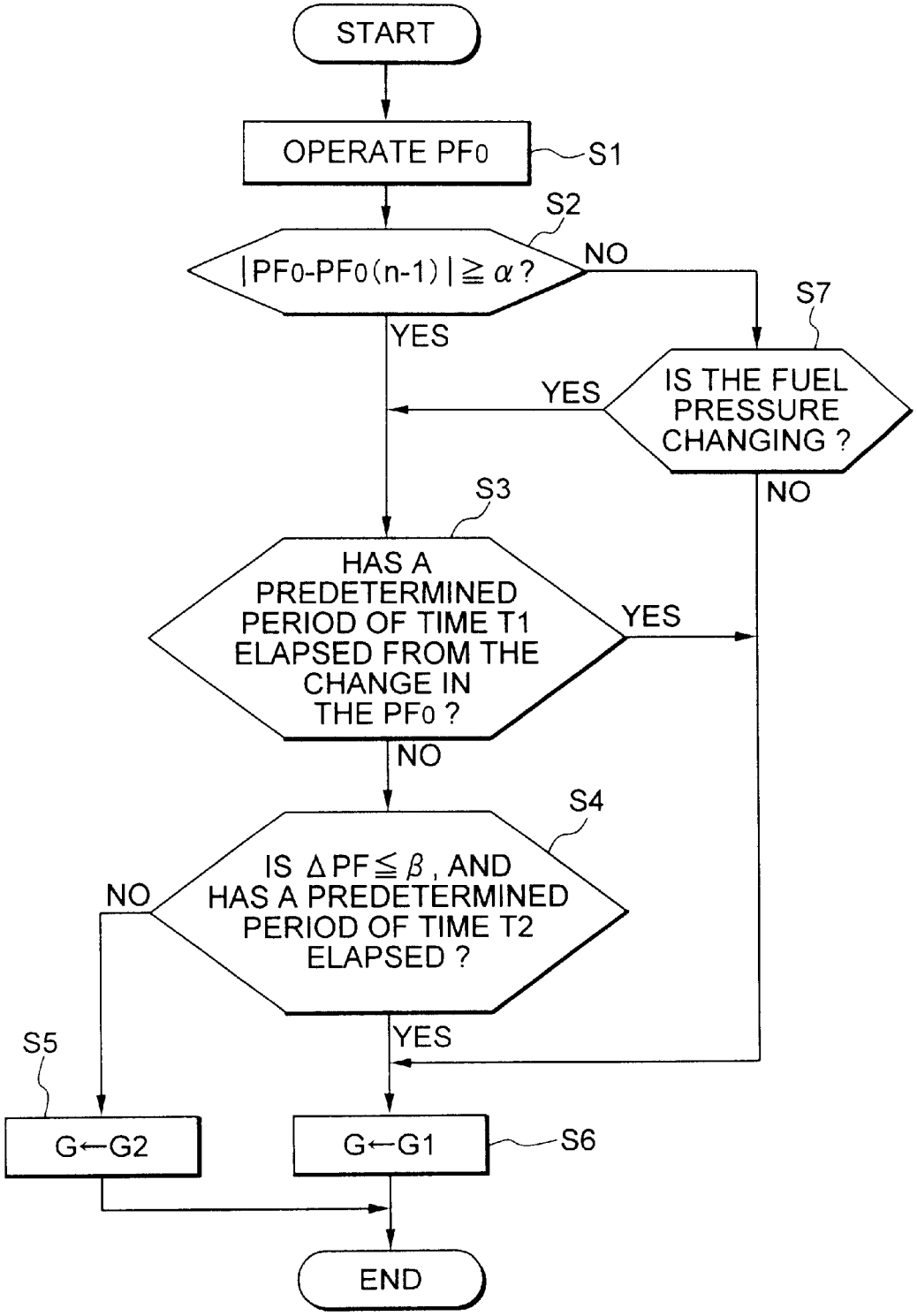
FIG. 5 is a flow chart illustrating the operation for setting the fuel pressure feedback control gain according to the embodiment 1 of the present invention.

FIG. 5 is a flow chart illustrating the operation for changing over the control gain in the fuel pressure feedback control, and illustrates the operation for changing over the control gain when the target fuel pressure PFo has changed by more than a predetermined amount (when the fuel pressure has changed) at moments B and C in FIG. 4.

Figure 6:
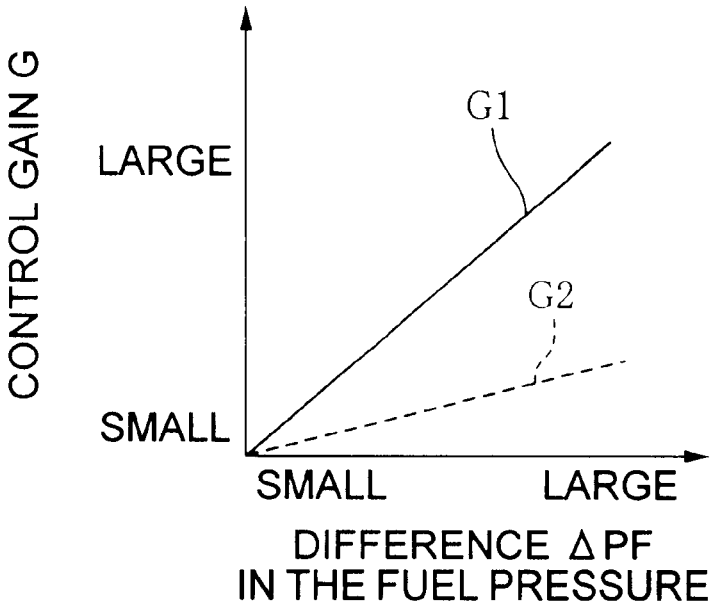
FIG. 6 is a diagram illustrating the difference in the fuel pressure—control gain characteristics for operating the control gain used in the means for operating the fuel pressure correction amount of FIG. 1.

FIG. 6 is a diagram illustrating a relationship between the difference ΔPF in the fuel pressure and the control gain G.

In FIG. 6, the characteristics of the control gain G for the difference ΔPF in the fuel pressure differ as represented by a solid line G1 and a broken line G2 depending upon when the fuel pressure is steady and the fuel pressure is changing.

Basically, the control gain G2 for when the fuel pressure is changing becomes smaller than the control gain G1 for when the fuel pressure is steady.

As shown in FIG. 6, further, when the control gain G is variable, the control gain G decreases with the decrease in the difference ΔPF in the fuel pressure, which, however, is not an absolute condition, and the control gain G may be fixed.

Figure 7:
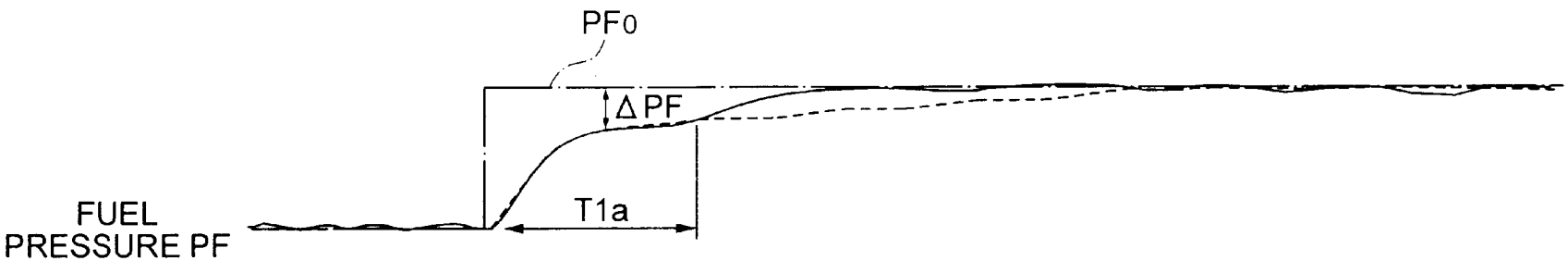
FIG. 7 is a timing chart illustrating the operation for forcibly changing over the fuel pressure feedback control gain during the high-speed operation according to the embodiment 1 of the present invention.
Figure 8:
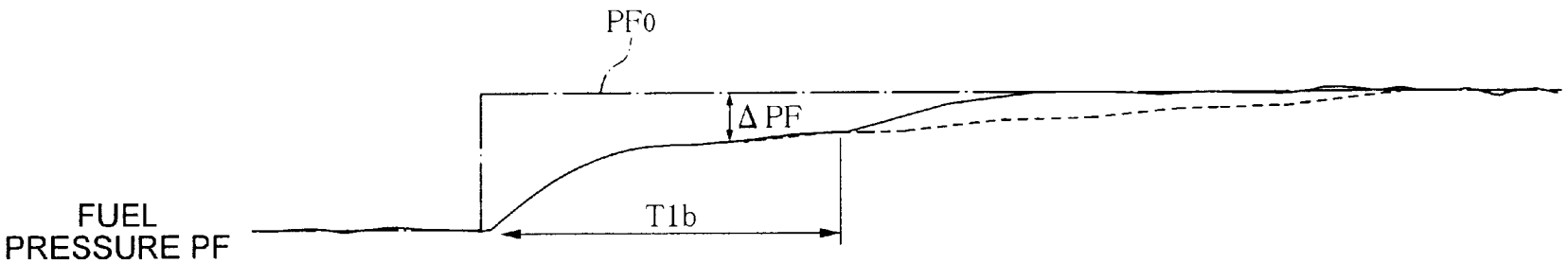
FIG. 8 is a timing chart illustrating the operation for forcibly changing over the fuel pressure feedback control gain during the low-speed operation according to the embodiment 1 of the present invention.

FIGS. 7 and 8 are timing charts illustrating a change in the real fuel pressure PF with the passage of time when the fuel pressure is changing (when the target fuel pressure PFo is sharply increasing), and wherein FIG. 7 illustrates a case when the engine is running at a high speed and FIG. 8 illustrates a case when the engine is running at a low speed.

In FIGS. 7 and 8, the predetermined periods of times T1*a* and T1*b* for returning the control gain G2 for when the fuel pressure is changing back to the control gain G1 for when the fuel pressure remains steady, are set to be different depending on the crank angle signal CA (engine rotational speed Ne).

That is, the predetermined period of time T1*a* of when running at a high rotational speed (see FIG. 7) is set to be shorter than the predetermined period of time T1*b* of when running at a low rotational speed (see FIG. 8).

The broken lines in FIGS. 7 and 8 represent a change in the fuel pressure PF with the passage of time in the case when the condition for returning to the control gain G1 after the passage of the predetermined period of time T1 is deleted.

Next, described below in detail with reference to FIGS. 2 to 8 is the operation for changing over the control gain in the fuel pressure feedback control operation by the means 204 for operating the fuel pressure correction amount according to the embodiment 1 of the present invention shown in FIG. 1.

Described here is the case where the target fuel pressure PFo sharply increases at the time B while steadily traveling (region A) and, then, the target fuel pressure PFo sharply decreases at the time D while steadily traveling (region C) as shown in FIG. 4.

The fuel pressure control logic is executed at a predetermined cycle at all times when the fuel pressure feedback permission condition has been held.

In FIG. 5, first, the means 201 for operating the target fuel pressure operates a target fuel pressure PFo from the engine rotational speed Ne and the engine load (step S1).

Next, the means 204 for operating the fuel pressure correction amount compares an absolute value of a difference between the target fuel pressure PFo of this time and the target fuel pressure PFo(n−1) of the previous time with a predetermined amount α, and judges whether the target fuel pressure PFo has changed by more than a predetermined amount α (step S2).

When it is judged at step S2 that IPFo−PFo(n−1) I≧α (i.e., YES), it is regarded that the target fuel pressure PFo has just sharply changed (fuel pressure has changed). Then, it is judged whether a predetermined period of time T1 has passed from the change in the target fuel pressure PFo (step S3).

That is, at step S3, it is judged whether the predetermined period of time T1 has passed from when the target fuel pressure PFo has changed by more than a predetermined amount α (from when the fuel pressure has started changing).

When the engine is not turning by a predetermined crank angle from a moment at which the fuel pressure has started changing and when it is judged at step S3 that the predetermined period of time T1 has not passed (i.e., NO), the condition is not holding true for forcibly returning the control gain back to the (first) control gain G1 for when the fuel pressure remains steady. It is then judged whether the state in which the difference ΔPF in the fuel pressure is converged within a predetermined range β has continued for a predetermined period of time T2 (<T1)(step S4).

The predetermined range β is set by taking the temperature of the fuel pressure regulator 15, voltage, aging, etc. into consideration.

When it is judged at step S4 that the predetermined period of time T2 has not elapsed (i.e., NO) despite ΔPF>β (i.e., NO) or ΔPF≧β, the means 204 for operating the fuel pressure correction amount selectively sets the (second) control gain G2 for when the fuel pressure is changing as a control gain G for feeding back the fuel pressure (step S5), and the processing routine of FIG. 5 ends.

When it is judged at step S4 that the state ΔPF≧β has continued for the predetermined period of time T2 (i.e., YES), the means 204 for operating the fuel pressure correction amount selectively sets the (first) control gain G1 for when the fuel pressure remains steady as a control gain G for feeding back the fuel pressure (step S6), and the processing routine of FIG. 5 ends.

Hereinafter, the control gain G is maintained until the next control cycle.

That is, the fuel pressure PF is controlled by feedback based on the control gain G1 or G2 (see FIG. 6) that varies depending on the present difference ΔPF in the fuel pressure.

On the other hand, when it is judged at step S2 that IPFo−PFo(n−1) I<α (i.e., NO), it is not just after a change in the fuel pressure. Therefore, it is then judged whether the fuel pressure is now changing based on the magnitude of difference ΔPF in the fuel pressure (step S7).

When the difference ΔPF in the fuel pressure is still great and it is judged at step S7 that the fuel pressure is changing (i.e., YES), then the routine proceeds to step S3 to repeat the above-mentioned processings.

On the other hand, when the difference ΔPF in the fuel pressure is nearly 0 (fuel pressure is steady) and it is judged at step S7 that the fuel pressure is not changing (i.e., NO), then, the routine proceeds to step S6 where the control gain G for feeding back the fuel pressure is selectively set as the control gain G1 for when the fuel pressure remains steady.

Further, when it is judged at step S3 that the predetermined period of time T1 has elapsed (the crank has turned by a predetermined angle) after the target fuel pressure PFo has changed by more than the predetermined amount α (i.e., YES), then, the routine proceeds to step S6.

In this case, the difference ΔPF in the fuel pressure poorly converges and an extended period of time is required for the convergence. At step S6, therefore, the control gain G for feeding back the fuel pressure is forcibly changed from the control gain G2 for when the fuel pressure is changing over to the control gain G1 for when the fuel pressure remains steady.

Thus, even when the difference ΔPF in the fuel pressure poorly converges, response in the fuel pressure PF is improved by the feedback control operation based on the control gain G1 (>G2), and the fuel pressure PF is brought into agreement with the target fuel pressure PFo in an early time.

The predetermined periods of times T1 and T2 at steps S3 and S4 are set depending upon the blow-out amount of the high-pressure pump 13 (rotational speed of the high-pressure pump 13), and have the same meanings as after the crank has turned by a predetermined angle.

Therefore, the predetermined periods of times T1 and T2 are set depending on the rotational speed (transient response of the fuel pressure PF) of the engine 1 (high-pressure pump 13).

The predetermined period of time T1 becomes short when the high-pressure pump runs at a high speed and becomes long when the high-pressure pump runs at a low speed, as represented by predetermined periods of times T1*a* and T1*b* in FIGS. 7 and 8.

Thus, upon selectively setting the control gain G2 in the fuel pressure feedback control operation of when the fuel pressure is changing to be smaller than the control gain G1 for when the fuel pressure remains steady, it is allowed to suppress the over-shooting amount or the under-shooting amount of the fuel pressure PF of when the fuel pressure is changing to a degree that does not hinder the control operation.

By discontinuing the feedback control operation when the fuel pressure is changing, further, the fuel pressure PF can be brought into agreement with the target fuel pressure PFo by controlling the fuel pressure by feedback based on the control gain G2 even when the difference ΔPF in the fuel pressure is not converged within the predetermined range β.

In this case, the controllability of when the fuel pressure is changing is not deteriorated as compared with the prior art according to which the feedback control is discontinued when the fuel pressure changes.

As a condition for returning the control gain G2 for when the fuel pressure is changing back to the control gain G1 for when the fuel pressure remains steady, there can be set the passage of the predetermined period of time T1 from when the target fuel pressure PFo has changed by more than a predetermined amount α (from when the fuel pressure starts changing) or the continuation of the predetermined period of time T2 in a state where the difference ΔPF in the fuel pressure lies within the predetermined range β, in order to further improve the controllability and convergence response of when the fuel pressure is changing.

When the fuel pressure PF that is controlled by feedforward when the fuel pressure changes, is greatly different from the target fuel pressure PFo due to dispersion in the fuel pressure regulator 15, temperature, voltage, aging, etc., an increased period of time is required for converging the difference ΔPF in the fuel pressure when the feedback control is relied upon by using the control gain G2, and the time for correcting the fuel pressure (control burden) increases.

Upon forcibly changing the control gain to the control gain G1 for when the fuel pressure remains steady after the passage of the predetermined period of time T1 from when the fuel pressure has started changing, however, the convergence response of the difference ΔPF in the fuel pressure can be improved.

When the fuel pressure remains steady as well as when the fuel pressure is changing, therefore, it is allowed to control the fuel pressure maintaining good stability, good accuracy in the fuel pressure and good response in the fuel pressure irrespective of dispersion in the exciting current Ri and in the fuel pressure PF caused by dispersion in the fuel pressure regulator 15, temperature, voltage and aging.

EMBODIMENT 2

In the above-mentioned embodiment, the predetermined period of time T1 was set as a condition for returning back to the control gain G1 in order to further quicken the convergence of the difference ΔPF in the fuel pressure of when the fuel pressure is changing. However, the condition for returning back to the control gain after the passage of the predetermined period of time T1 (step S3 in FIG. 5) may be deleted.

In this case, the returning condition (step S4) holds after the passage of the predetermined period of time T2 from when the difference ΔPF in the fuel pressure has converged within the predetermined range β, and the control gain G2 returns back to the control gain G1.

As represented by broken lines in FIGS. 7 and 8, therefore, the fuel pressure PF can be reliably converged into the target fuel pressure PFo though the converging time becomes longer than that of the change in the fuel pressure PF (see solid line) of when the return condition of step S3 is added.

EMBODIMENT 3

In the above-mentioned embodiment 1, the predetermined periods of times T1 and T2 are corresponded to the rotational angle of the crank and are variably set depending upon the engine rotational speed Ne. However, the predetermined periods of times T1 and T2 may be set constant irrespective of the engine rotational speed Ne.

EMBODIMENT 4

In the above-mentioned embodiment 1, the control gains G1 and G2 are variably set depending upon the difference ΔPF in the fuel pressure as shown in FIG. 6. However, the control gains G1 and G2 may be set constant irrespective of the difference ΔPF in the fuel pressure.

As shown in FIG. 6, further, the control gains G1 and G2 are variably set using a primary function exclusively set by the difference ΔPF in the fuel pressure. However, the control gains G1 and G2 may be variably set to different values depending upon when the difference ΔPF in the fuel pressure is changing in the positive direction or in the negative direction.

EMBODIMENT 5

In the above-mentioned embodiment 1 as shown in FIG. 9, the fuel pressure regulator 15 is used as the fuel pressure-varying means for adjusting the amount of fuel returned from the high-pressure return conduit 14A. This, however, can be applied to any modified embodiment. For example, any other fuel pressure-varying means may be employed being arranged on the upstream side of the high-pressure pump 13.

What is claimed is:

1. A device for controlling fuel pressure in a direct cylinder fuel injection engine comprising:

various sensors for detecting the operating conditions of an engine;

an injector for directly injecting fuel into a cylinder of said engine;

a pump for feeding fuel to said injector;

a conduit system for connecting said pump to said injector;

a fuel pressure detecting means for detecting the fuel pressure acting on said injector;

a fuel pressure varying means for adjusting said fuel pressure; and a control means for so controlling the fuel pressure by feedback that said fuel pressure is brought into agreement with a target fuel pressure; wherein said control means includes a means for controlling a fuel pressure correction amount by variably setting a control gain for controlling the fuel pressure by feedback; and said means for controlling the fuel pressure correction amount changes the control gain when said target fuel pressure has changed by more than a predetermined amount, from a first control gain to a second control gain different from the first control gain.

2. A device for controlling the fuel pressure in a direct cylinder fuel injection engine according to claim 1, wherein the means for controlling the fuel pressure correction amount returns the control gain to said first control gain at a predetermined period of time after the control gain is changed from said first control gain to said second control gain.

3. A device for controlling the fuel pressure in a direct cylinder fuel injection engine according to claim 1, wherein the means for controlling the fuel pressure correction amount returns the control gain to said first control gain after a difference between said target fuel pressure and said fuel pressure has remained within a predetermined range for a predetermined period of time.

4. A device for controlling the fuel pressure in a direct cylinder fuel pressure in a direct cylinder fuel injection engine according to claim 1, wherein the means for controlling the fuel pressure correction amount variably sets said second control gain depending upon the operating conditions.

5. A device for controlling the fuel pressure in a direct cylinder fuel injection engine according to claim 1, wherein the means for controlling the fuel pressure correction amount variably sets said second control gain depending upon a difference between said target fuel pressure and said fuel pressure.

* * * * *